US011680730B2

(12) United States Patent
Forshaw et al.

(10) Patent No.: US 11,680,730 B2
(45) Date of Patent: Jun. 20, 2023

(54) CONDENSATE PUMP ASSEMBLY

(71) Applicant: Aspen Pumps Limited, East Sussex (GB)

(72) Inventors: Christopher Forshaw, East Sussex (GB); Christoper Gee, East Sussex (GB); Joseph Sharpestone, East Sussex (GB)

(73) Assignee: Aspen Pumps Limited, East Sussex (GB)

( * ) Notice: Subject to any disclaimer, the term of this patent is extended or adjusted under 35 U.S.C. 154(b) by 0 days.

(21) Appl. No.: 17/263,655

(22) PCT Filed: Jun. 5, 2019

(86) PCT No.: PCT/GB2019/051550
§ 371 (c)(1),
(2) Date: Jan. 27, 2021

(87) PCT Pub. No.: WO2020/021222
PCT Pub. Date: Jan. 30, 2020

(65) Prior Publication Data

US 2021/0293447 A1 Sep. 23, 2021

(30) Foreign Application Priority Data

Jul. 27, 2018 (GB) ..... 1812281

(51) Int. Cl.
*F24F 13/22* (2006.01)
*F04B 23/02* (2006.01)
*F04B 53/00* (2006.01)

(52) U.S. Cl.
CPC ..... *F24F 13/222* (2013.01); *F04B 23/025* (2013.01); *F04B 53/003* (2013.01)

(58) Field of Classification Search
CPC ..... F24F 13/222; F24F 13/24; F04B 23/025; F04B 53/003; F04B 53/20; F04D 29/668
See application file for complete search history.

(56) References Cited

U.S. PATENT DOCUMENTS 3,758,236 A * 9/1973 Zimmerman ..... F04D 29/426 417/360
4,974,551 A 12/1990 Nelson
(Continued)

FOREIGN PATENT DOCUMENTS

CN 207583464 U 7/2018
DE 1414874 U 8/1937
(Continued)

OTHER PUBLICATIONS

International Search Report for Application No. PCT/GB2019/051550 dated Feb. 18, 2020, 6 pages.
(Continued)

*Primary Examiner* — Nathan C Zollinger
(74) *Attorney, Agent, or Firm* — Seyfarth Shaw LLP

(57) ABSTRACT

A condensate pump assembly for use in an air conditioning system, the condensate pump assembly comprising: a pump arranged in a housing to pump liquid from a liquid inlet to a liquid outlet; a liquid receptacle configured to receive liquid from the liquid inlet; and suspension means configured to suspend the pump from a bottom surface of the housing. The suspension means are configured to substantially eliminate vibrations being transmitted from the pump to the housing.

19 Claims, 5 Drawing Sheets

(56) References Cited

U.S. PATENT DOCUMENTS

| | | | | |
|---|---|---|---|---|
| 5,429,483 | A * | 7/1995 | Tamari | A61M 60/279 417/474 |
| 6,322,326 | B1 * | 11/2001 | Davis | F04D 29/628 417/279 |
| 6,380,522 | B1 * | 4/2002 | Bochud | D06F 75/12 219/494 |
| 2002/0000093 | A1 | 1/2002 | Lea | |
| 2003/0221439 | A1 | 12/2003 | Bush et al. | |
| 2004/0060314 | A1 | 4/2004 | Gunji et al. | |
| 2007/0224050 | A1 * | 9/2007 | Ward | F04D 13/16 417/41 |
| 2009/0053073 | A1 * | 2/2009 | Ward | F04D 29/708 417/40 |
| 2010/0192610 | A1 | 8/2010 | Yoshitake et al. | |
| 2018/0339102 | A1 * | 11/2018 | Barraud | F04B 43/095 |
| 2020/0355181 | A1 * | 11/2020 | Saich | B01D 35/02 |

FOREIGN PATENT DOCUMENTS

| | | | | |
|---|---|---|---|---|
| DE | 1291454 | B | 3/1969 | |
| DE | 9204150 | U1 | 7/1992 | |
| EP | 1028297 | A2 | 8/2000 | |
| EP | 1403591 | A1 | 3/2004 | |
| EP | 1707820 | A2 | 10/2006 | |
| EP | 2014998 | A2 * | 1/2009 | F24F 13/222 |
| EP | 2014998 | A2 | 1/2009 | |
| EP | 2199701 | A1 | 6/2010 | |
| GB | 2568285 | A | 5/2019 | |
| KR | 20130000893 | A | 1/2013 | |
| WO | 9009546 | A1 | 8/1990 | |

OTHER PUBLICATIONS

Written Opinion for Application No. PCT/GB2019/051550 dated Feb. 18, 2020, 15 pages.

Search Report for Application No. GB1812281.2 dated Sep. 8, 2020, 4 pages.

Search Report for Application No. GB2019808.1 dated Jan. 5, 2021, 5 pages.

Search Report for Application No. GB2019809.9 dated Jan. 5, 2021, 4 pages.

* cited by examiner

CONDENSATE PUMP ASSEMBLY

CROSS REFERENCE TO RELATED APPLICATIONS

This is a National Stage application of, and claims priority to, PCT/GB2019/051550, filed Jun. 5, 2019, which further claims priority to GB Patent Application No. 1812281.2, filed Jul. 27, 2018, the disclosures of which are incorporated herein by reference in their entirety.

This invention relates to a condensate pump assembly and a method of assembling the same.

BACKGROUND

Condensate pump assemblies are used to pump liquid condensate from appliances that produce condensate, for example an air conditioning system, a condensing boiler system or a refrigerator, out of a room or building. In a typical air conditioning system, the air conditioning unit produces liquid condensate, i.e. water, which drains from the air conditioning unit to a liquid reservoir in the form of a liquid receptacle in a condensate pump assembly mounted to a wall of the room or building, typically below the air conditioning unit. When the liquid receptacle is sufficiently filled with liquid, the liquid is pumped from the liquid receptacle via a liquid inlet and away from the condensate pump assembly, for example outside the room, via a liquid outlet. After sustained operation of the condensate pump assembly, contaminants such as dirt may enter the liquid receptacle and are not removed by the pump. The liquid receptacle can be made removable from a housing of the condensate pump assembly to allow cleaning of contaminants from the liquid receptacle.

In condensate pump assemblies of the prior art, a clamshell cover is affixed to the condensate pump assembly to secure the liquid receptacle in place in the condensate pump assembly, as well as to act as a sheath to improve the aesthetic appearance of the condensate pump assembly by hiding the liquid receptacle from view. Not only do such covers require two hands to remove, they also increase the size of the condensate pump assembly and create an additional source of noise by rattling against a housing of the condensate pump assembly during operation of the pump.

In condensate pump assemblies of the prior art, liquid receptacles may have condensate form on the outer surface of the liquid receptacle due to temperature differences across the receptacle wall. The formation of condensate is undesirable, as condensate may drip from the receptacle and onto surfaces or objects below, causing water damage in the process.

In condensate pump assemblies of the prior art, operation of the pump within the condensate pump assembly can lead to noise being generated by the pump assembly, this is undesirable not only for aesthetic reasons, but also as vibrations may be significant to damage any mechanical fixations used to secure the condensate pump assembly against a wall.

In condensate pump assemblies of the prior art, presenting operating status of the condensate pump assembly typically relies on holes being made in the cover of the assembly and locating an LED in the hole, such that a user is able to easily see the status of the pump assembly. It is highly desirable to be able to present the operating status information without needing to have an external cover with a series of holes. This would lead to more aesthetically appealing units, but also ensure the condensate pump assembly housing remains sealed.

The present disclosure seeks to provide at least an alternative to condensate pump assemblies of the prior art.

BRIEF SUMMARY OF THE DISCLOSURE

Viewed from a first aspect, there is provided a condensate pump assembly for use in an air conditioning system, the condensate pump assembly comprising a pump arranged in a housing to pump liquid from a liquid inlet to a liquid outlet; and a liquid receptacle configured to receive liquid from the liquid inlet. The liquid receptacle comprises an inner wall defining a liquid receiving volume and an outer wall defining an outer extent and an insulating gap is formed between the inner and outer wall.

Thus, a condensate pump assembly with a liquid receptacle having a significantly lower risk of forming condensation on outer surface is provided. This is useful because the air-conditioning unit may be located in an environment where the ambient conditions need to be tightly controlled. The insulating gap would greatly reduce the risk of condensate forming and dripping into the controlled environment. It would be understood that while it may be preferable to have the insulating gap filled with air, other gases or combinations of gases able to form the insulating gap would be appropriate. Similarly, natural or synthetic materials may be contained within the insulating gap.

The inner wall may be welded to the outer wall. The weld may be achieved by ultrasonic welding.

The liquid receptacle may comprise a raised section configured to dissipate energy within liquid entering from the liquid inlet. This is advantageous, as reducing pulsations within liquid entering the liquid receptacle will help to reduce the noise emitted from the condensate pump assembly during operation.

A filter may be secured within the liquid receiving volume, such that the filter crosses a fluid flow path between the liquid inlet and the pump. This will prevent particulate debris over a certain size from reaching the pump, further reducing the noise of the pump assembly during operation. The condensate pump assembly may comprise an annular member secured to the fluid inlet and configured to receive a liquid inlet line. The annual member may be twin-shot moulded to the fluid inlet.

The condensate pump assembly may comprise suspension means configured to suspend the pump from a bottom surface of the housing. The suspension means may be configured to substantially eliminate vibrations being transmitted from the pump to the housing. This, in itself, is believed to be novel and so, in accordance with a further aspect of the present disclosure, there is provided a condensate pump assembly for use in an air conditioning system, the condensate pump assembly comprising a pump arranged in a housing to pump liquid from a liquid inlet to a liquid outlet; a liquid receptacle configured to receive liquid from the liquid inlet; and suspension means configured to suspend the pump from a bottom surface of the housing. The suspension means are configured to substantially eliminate vibrations being transmitted from the pump to the housing. By suspending the pump from the housing, vibrations that would have otherwise been transferred to the housing, due to the pump being mounted to the housing, can be absorbed by the suspension means. Thus, the noise emitted by the condensate pump assembly during operation can be greatly reduced.

The suspension means may comprise a first tube element configured to connect the liquid reservoir to a pump inlet, and a second tube element configured to connect a pump outlet to the liquid outlet. The first tube element may comprise a first hardness and the second tube element may comprise a second hardness. This reduces the transmission of vibrations from the pump to the housing. The first hardness may be different to the second hardness. The first hardness and second hardness may be in the range of 50-60 ShA.

The suspension means may comprise a cradle member configured to suspend the pump. The cradle member may comprise a plurality of arms extending to the housing and configured to attach to the housing and support the pump. When a cradle member is present, the first hardness and second hardness may be in the range of 30-40 ShA.

The condensate pump assembly may comprise one or more rings arranged around the second tube element. The second tube element may extend through the one or more rings. The one or more rings restricts the expansion of the second tube element member in a radial direction of each of the one or more rings. The one or more rings effectively harden the second tube element, to prevent excessive expansion and possible rupture of the second tube element, while utilising the noise-reducing properties of the soft second tube element.

This, in itself, is believed to be novel and so, in accordance with a further aspect of the present disclosure, there is provided a condensate pump assembly for use in an air conditioning system, the condensate pump assembly comprising a pump arranged in a housing to pump liquid from a liquid inlet to a liquid outlet; a liquid receptacle configured to receive liquid from the liquid inlet; a tube element connecting the pump outlet to the liquid outlet, and one or more rings arranged around the tube element. The tube member extends through the one or more rings, and the one or more rings restrict the expansion of the tubular member in a radial direction of each of the one or more rings. As the one or more rings will have a larger outer diameter than the tube element, this will allow the one or more rings to resist the hoop stresses imparted by tube expansion whilst being made of a sufficiently soft material to minimise the effects of the pulsations from the pump.

The one or more rings may be equally spaced between the pump and the fluid outlet. The one or more rings may have a hardness in the range of 60-70 ShA.

The condensate pump assembly may further comprise at least one light source configured to emit a signal indicative of the status of the condensate pump assembly and a light tube configured to transmit the signal. The housing may further comprise an upper portion and opposed side walls, and the side walls may be configured such that, in use, the signal is visible from outside the housing.

This, in itself, is believed to be novel and so, in accordance with a further aspect of the present disclosure, there is provided a condensate pump assembly for use in an air conditioning system, the condensate pump assembly comprising a pump arranged in a housing to pump liquid from a liquid inlet to a liquid outlet; a liquid receptacle configured to receive liquid from the liquid inlet; and at least one light source configured to emit a signal indicative of the status of the condensate pump assembly and a light tube configured to transmit the signal. The housing may further comprise an upper portion and opposed side walls, and the side walls may be configured such that, in use, the signal is visible from outside the housing. This is advantageous as a condensate pump assembly may be mounted to a wall in more than one orientation. Therefore, it is desirable to be able to display a signal indicative of the operating status of the condensate pump assembly to a user irrespective of the orientation in which the pump assembly is installed.

The light tube may comprise a first light path to one of the side walls and a second light path to the other of the side walls, whereby the signal is visible through either of the opposed side walls. Each of the opposed side walls may comprise a thinned section, and the light tube may be configured to direct the signal towards the thinned sections. This is advantageous as it allows light to easily pass through the side walls of the housing while maintaining a sealed condensate pump assembly.

The condensate pump assembly may comprise a fluid outlet chamber having a bottom wall and a plurality of side walls. The fluid outlet chamber may be secured to an upper portion of the housing, and a first side wall may comprise a liquid inlet channel in fluid communication with the pump. The fluid outlet chamber may comprise a dividing wall extending between opposed second and third side walls to define first and second fluid regions within the fluid outlet chamber, the second fluid region may be configured to maintain a pocket of air, and pulsations within liquid entering the liquid outlet chamber are dissipated by the pocket of air prior to liquid being discharged through the liquid outlet.

This, in itself, is believed to be novel and so, in accordance with a further aspect of the present disclosure, there is provided a condensate pump assembly for use in an air conditioning system, the condensate pump assembly comprising a pump arranged in a housing to pump liquid from a liquid inlet to a liquid outlet; a liquid receptacle configured to receive liquid from the liquid inlet; and a fluid outlet chamber having a bottom wall and a plurality of side walls. The fluid outlet chamber may be secured to an upper portion of the housing, and a first side wall comprises a liquid inlet channel in fluid communication with the pump. The fluid outlet chamber may comprise a dividing wall extending between opposed second and third side walls to define first and second fluid regions within the fluid outlet chamber, the second region may be configured to maintain a pocket of air, and pulsations within liquid entering the liquid outlet chamber are dissipated by the pocket of air prior to liquid being discharged through the liquid outlet. Thus, the liquid being discharged from the pump assembly will have significantly reduced pulsations and any rattling of the discharge line against external housing surfaces or trunking will be greatly reduced.

The liquid inlet channel may be configured to direct liquid towards a protrusion extending from a fourth side wall, which may be opposed to the first side wall. The protrusion acts to redirect the liquid flow in the opposite direction without producing turbulent flow, which would generate more noise within the fluid outlet chamber.

The liquid inlet channel may have an internal profile that tapers in the direction of fluid flow. The fluid outlet may be comprised within a fluid outlet member, the fluid outlet member may comprise an air inlet channel, and the air inlet channel may extend into the first fluid region. The fluid outlet member may be welded to an upper housing portion.

The air inlet channel may comprise a one-way valve configured to allow air to flow into the fluid outlet chamber. The air inlet channel may comprise a damper located upstream of the one-way valve, and the damper may be configured to dampen noise emitted from the one-way valve. The damper may be contained within the one-way valve. The damper may comprise a second one-way valve.

The bottom wall may be welded to the plurality of side walls. The pump outlet may be connected to the liquid inlet channel by a connecting tube, and the connecting tube may be sealed to the first side wall by a retaining cap. The liquid outlet may comprise a barbed male member configured to connect to a discharge line.

The liquid receptacle may be releasably secured to the housing. The liquid receptacle may be releasably secured to the housing by selective release means. The selective release means may comprise at least one snap-fit joint. The selective release means may comprise a resilient member biased to hold the liquid receptacle in the first position and movable to release the liquid receptacle for movement from the first position towards the second position. The selective release means may comprise a peg member configured, in use, to apply a force against the housing to secure the liquid receptacle when attached to the housing. This, in itself, is believed to be novel and so, in accordance with a further aspect of the present disclosure, there is provided a condensate pump assembly for use in an air conditioning system, the condensate pump assembly comprising a pump arranged in a housing to pump liquid from a liquid inlet to a liquid outlet; a liquid receptacle configured to receive liquid from the liquid inlet. The liquid receptacle may be releasably secured to the housing by selective release means. The selective release means may comprise a peg member configured, in use, to apply a force against the housing to secure the liquid receptacle when attached to the housing. The selective release means may comprise a resilient member biased to hold the liquid receptacle in the first position and movable to release the liquid receptacle for movement from the first position towards the second position.

The liquid receptacle may comprise a support member configured to resist bending of the peg member. The liquid receptacle may be configured to be releasable by a hand of a user. The selective release means may be operable by squeezing a thumb of the hand towards a finger of the hand.

The condensate pump assembly may comprise a liquid level sensor configured to detect a liquid level within the liquid receptacle, and a controller configured to operate the pump when the liquid level sensor outputs a first signal indicative of a liquid level within the liquid receptacle above a level of the liquid inlet to the pump and to stop the pump when the liquid level sensor outputs a second signal indicative of a liquid level within the liquid receptacle approaching or below a level of the liquid inlet to the pump.

Viewed from a further independent aspect, the present disclosure provides a method of assembling a fluid outlet chamber comprising the steps of providing a housing configured to contain a liquid reservoir, a pump, a fluid outlet chamber having a plurality of side walls and a bottom wall, a connecting tube configured to receive a pump outlet, and a retaining cap configured to receive the connecting tube, welding the bottom wall to the plurality of side walls, welding the retaining cap to a first side wall of the fluid outlet chamber to seal the connecting tube to the fluid outlet chamber, and securing the fluid outlet chamber to an upper housing portion by welding the plurality of side walls to the upper housing portion.

The method may comprise the steps of providing a fluid outlet member having a fluid outlet and an air inlet, and an air inlet channel within the upper housing portion, and welding the fluid outlet member to the upper housing portion.

The method may comprise the step of securing a one-way valve within the air inlet channel when welding the fluid outlet member to the upper housing portion. The welds of the method may be achieved by ultrasonic welding.

The housing may comprise a shroud portion extending over a side wall of the liquid receptacle, whereby to hide the side wall of the liquid receptacle from view when the liquid receptacle is in the first position in the housing. The shroud portion may extend over all side walls of the liquid receptacle. Thus, a separate removable cover of the condensate pump assembly is not required for aesthetic reasons to hide the liquid receptacle from view when in the first position in the housing.

The release means may be operable by either hand of the user. Thus, the condensate pump assembly may be mountable to a wall surface in either of two rotational positions, spaced by 180 degrees, depending on the particular space availability in the vicinity of a connected air conditioning unit. The release means can be operated whether the condensate pump assembly is mounted in a first configuration, or a second configuration, rotated by 180 degrees relative to the first configuration about an axis aligned with a direction of gravity in use. This means the same tooling can be used to produce at least some components of the condensate pump assembly which are suitable for use in either of the first configuration or the second configuration.

BRIEF DESCRIPTION OF THE DRAWINGS

Embodiments of the invention are further described hereinafter with reference to the accompanying drawings, in which.

DETAILED DESCRIPTION

Figure 1:
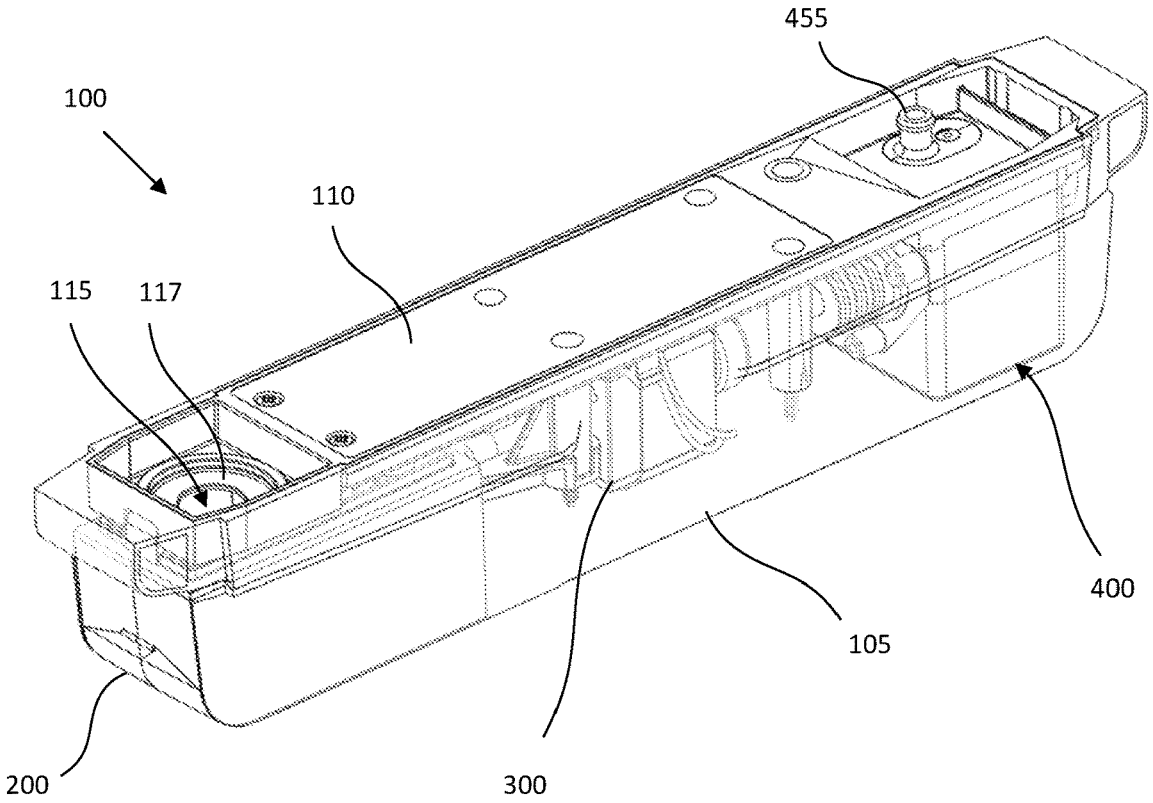
FIG. 1 is an illustration of a condensate pump assembly with a portion of the housing shown transparent.

FIG. 1 is an illustration of a condensate pump assembly with a portion of the housing shown transparent. The condensate pump assembly 100 comprises a housing 105 to contain a pump 300, a liquid receptacle 200 having a fluid inlet 115, a fluid outlet chamber 400 having a fluid outlet 455. An upper housing portion 110 is shown mounted to the housing 105. A seal is formed between the upper housing portion 110 and housing 105 by a gasket 135. The pump 300 may be a reciprocating pump. The reciprocating pump 300 is a well-known pump and the skilled person would readily understand how to provide such a pump. The housing 105 is typically formed from plastics. A reciprocating axis of the reciprocating pump 300 is aligned with a longitudinal direction of the condensate pump assembly 100. Thus, a height and a depth (distance away from the wall when mounted) of the condensate pump assembly 100 can be small. When the condensate pump assembly 100 is installed as part of an air conditioning system, the fluid outlet 455 is in fluid communication with a liquid drain (not shown) so that excess liquid can be removed from the air conditioning system. The housing 105 preferably comprises a skirt 117 that closes any gaps around the fluid inlet 115 to prevent noise being emitted from the liquid receptacle 200. The skirt 117 is preferably made from a rubberised material to accommodate different sizes of inlet pipe, including inlet pipes that have an outer diameter larger than the internal diameter of the skirt 117. The skirt 117 also acts to suspend the inlet pipe off the base surface 225 of the reservoir 200 to maintain the flow of liquid into reservoir 200. The skirt 117 is preferably twin-shot moulded to the fluid inlet 115.

Figure 2:
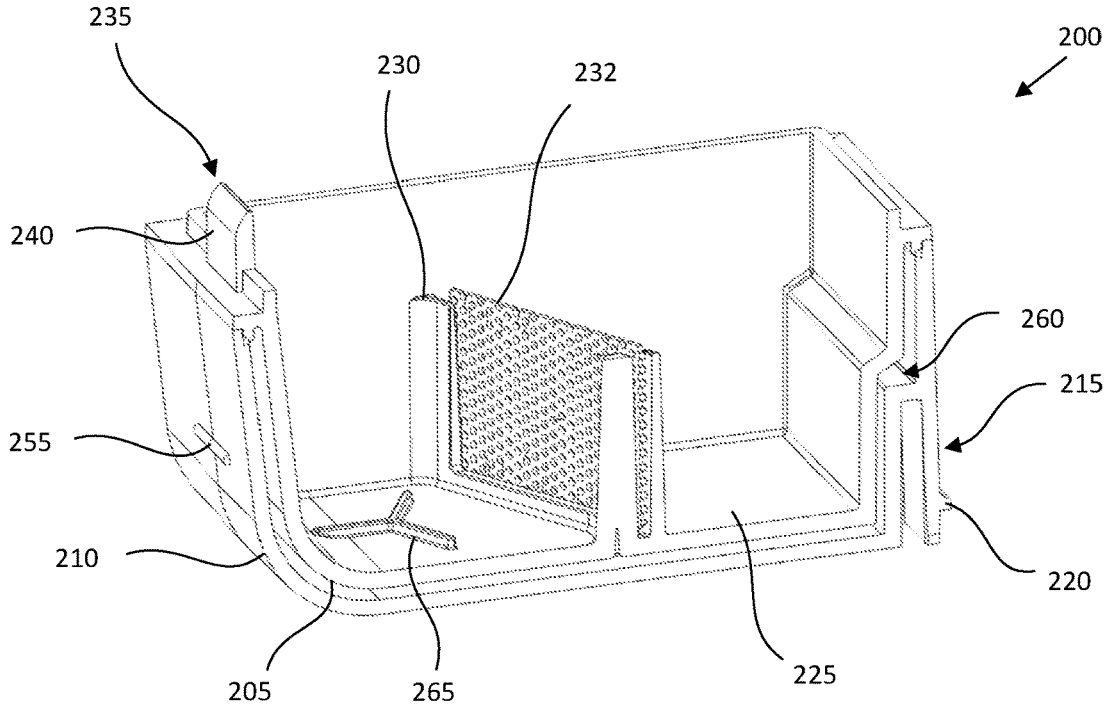
FIG. 2 is a cross-sectional view of the liquid receptacle.

FIG. 2 is a cross-sectional view of the liquid receptacle 200. An upper portion of the liquid receptacle 200 is open to receive condensate from an air conditioning unit (not shown) via the fluid inlet 115. The liquid receptacle 200 is shown having an inner wall 205 and an outer wall 210 sealed together to form an insulating gap 260 extending around substantially the entire outer surface of the inner wall 205. By surrounding the inner wall 205 the insulating gap 260, the insulating effects are maximised and the risk of condensate forming on the outer surface of the outer wall 210 is minimised. Preferably the insulating gap 260 is filled with air. However, other gaseous compositions or insulating material may be included within the insulating gap 260.

A pair of support members 230 is also shown extending from the base surface 225 and configured to secure a filter 232 within the liquid receptacle 200. By placing the filter 232 in the fluid flow path between the fluid inlet and the pump and securing the filter 232 such that the filter 232 extends across the width of the liquid receptacle, larger particulate debris can be prevented from reaching the pump 300. The filter 232 has a length along the surface of the filter 232 in a direction across the liquid receptacle 200 greater than the distance between the facing walls of the liquid receptacle 200. This ensures that the cross-sectional area of the filter 232 is greater than the cross-sectional area of the distance directly across the liquid receptacle 200 whereby to improve the capacity of the filter 232. While the filter 232 is shown comprising a plurality of circular holes, it would be apparent that other shapes of holes may be used. While a pair of supports members 230 have been shown, it would be apparent that other arrangements may be used to secure the filter 232. Such arrangements may include more or fewer than two extending members 230. The filter 232 may be secured to the underside of the upper housing portion 110 or the base surface 225 of the liquid receptacle 200. The filter 232 may be secured by slots or grooves within the surfaces that define the liquid receiving volume.

Figure 3:
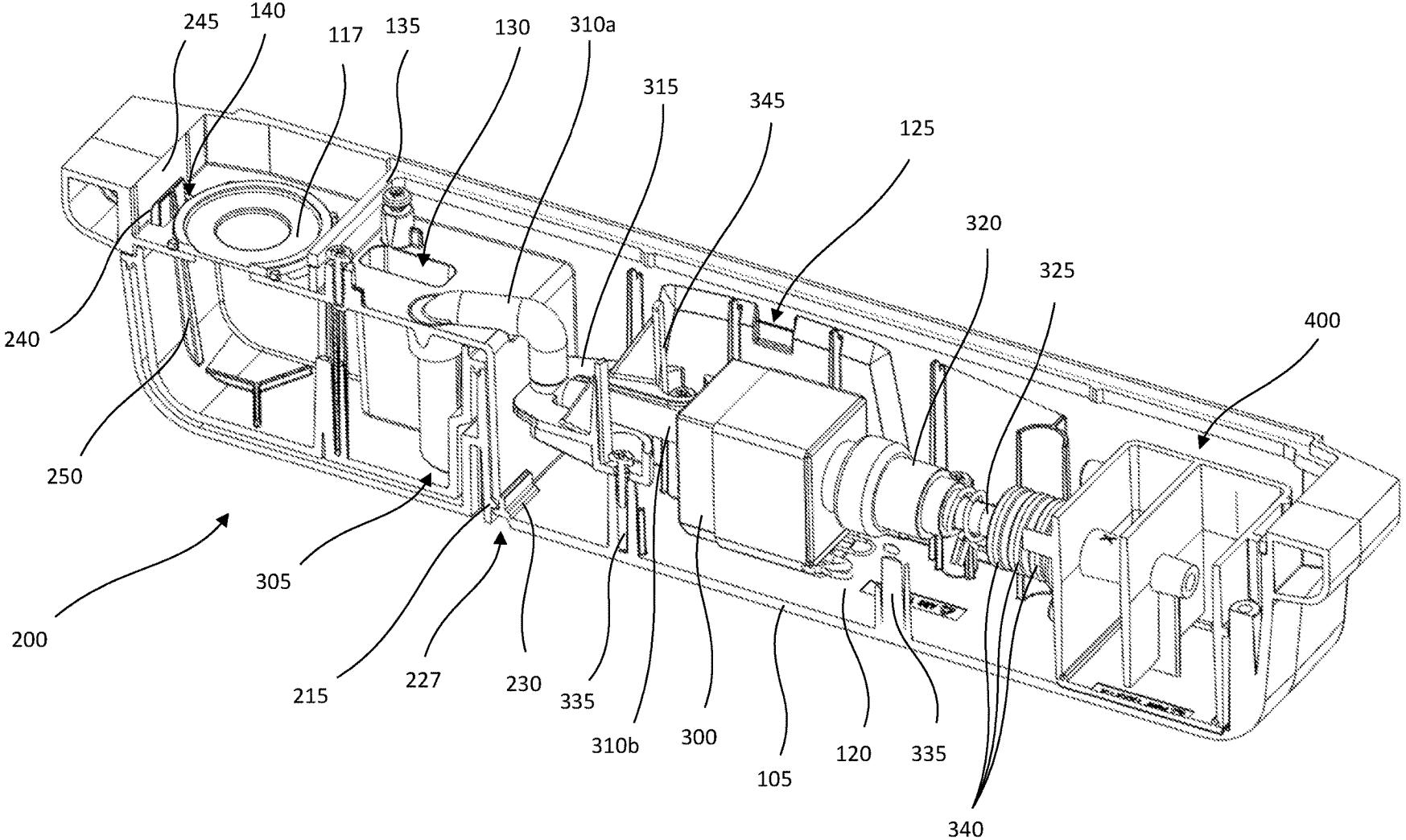
FIG. 3 is a cross-sectional view of the condensate pump assembly showing internal components of the condensate pump assembly.

The liquid receptacle 200 may be secured to the housing 105 by selective release means. The selective release means allows the liquid receptacle 200 to be movable from a first position, as shown in FIG. 3, to a second position removed from the housing 105. As shown in FIG. 2, the selective release means may include a resilient clip 215 and a peg 235 at the opposite end of the liquid receptacle 200 configured, in use, to apply a force against the housing 105 to secure the liquid receptacle 200 when attached to the housing 105. The force may be applied against an inner surface 245 of the housing 105 via an outer surface 240 of the peg 235. The illustrated arrangement allows a user to remove the liquid receptacle 200 from the housing 105, for example to clear the filter 232 of debris, by squeezing their thumb and finger together. This means a user is able to remove the liquid receptacle 200 using only a single hand. For example, the user is able to remove the liquid receptacle 200 by squeezing together their thumb and finger of their left or right hand. By enabling the removal of the liquid receptacle 200 with either hand, the flexibility of the present arrangement is further improved. The action of squeezing the thumb and finger together releases the resilient clip 215 from the housing 105 and releases a protrusion 220 of the resilient clip 215 from the corresponding recess 230 in the housing 105 (see also FIG. 3) used to secure the liquid receptacle 200 in the housing 105. By squeezing the resilient clip 215 and outer wall 210 using opposing digits on a hand of a user, the resilient clip 215 can be disengaged from its respective lip, and in a single movement of the hand, release the liquid receptacle 200 for movement from the first position towards the second position. The movement of the liquid receptacle 200 after disengagement of the resilient clip 215 is substantially downwards in use. It will be understood that the selective release means is operable by any one of the hands of a user, and does not require both hands of a user, neither does such operation require one particular hand of the user. That is to say, the left or right hand of the user may be used to operate the selective release means. Furthermore, squeezing the resilient clip 215 and outer wall 210 also serves to grip the liquid receptacle 200 securely in the hand of a user, preventing accidental spillage of the contents thereof. In the present example, the resilient clip 215 and outer wall 210 can be squeezed between a thumb and forefinger of the same hand for to release the liquid receptacle 200 from the first position. The outwardly biased resilient clip 215 and peg 235 exert a pressure against the respective corresponding recess 230 and inner wall 245, whereby to substantially prevent any rattle of the liquid receptacle 200 in the housing 105 when the liquid receptacle 200 is secured in the first position in the housing 105. The user's thumb or finger may be received by a slot 227 in the housing 105 to enhance the user's grip on the liquid receptacle 200 prior to squeezing the resilient clip 215. The outer wall 210 may have a protrusion 255 to further enhance the user's grip on the liquid receptacle 200. The thumb or finger of a user may rest on the protrusion 255 when removing the liquid receptacle 200 from the housing 105. The peg 235 may be stiffened by a support member 250 extending from the inner wall 205. The peg 235 may have a first longitudinal axis and the support member 250 may have a second longitudinal axis and the first longitudinal axes may be substantially parallel to the second longitudinal axis. The support member 250 may extend the length of the peg 235. While a resilient clip 215, in the form of a cantilever joint, and peg 235 are illustrated here, it would be apparent that other releasable joints may be used to secure the liquid receptacle 200. While a protrusion 255 in the form of a horizontal bar is illustrated in FIG. 2, it would be apparent that other arrangements to enhance the user's grip on the outer wall 210 are possible. Outer wall 210 may include one or more high friction materials to enhance the user's grip on the outer wall 210. For example, the outer wall may include one or more rubberised sections. The outer wall may be made from one or more thermally insulating materials, such as plastic.

FIG. 3 is a cross-sectional view of the condensate pump assembly showing internal components of the condensate pump assembly. The cross-sectional view of the condensate pump assembly 100 is taken through a vertical plane aligned along a longitudinal axis of the condensate pump assembly 100. The housing 105 extends over the liquid receptacle 200 and has a liquid inlet 115 formed within a surface of the housing 105 that receives the liquid receptacle 200. The liquid receptacle 200 is also shown having a raised section 265 extending from the base surface 225 of the inner wall 205. The raised section 265 is arranged to be located under the fluid inlet 115 to prevent the inlet pipe from resting against the bottom surface 225 of the reservoir 200. While it is preferable to have raised section 265 under the fluid inlet 115, the raised section 265 and/or skirt 117 are not essential to the present invention. While a raised section 265 comprising three extensions arranged in a radial manner is illustrated in FIGS. 2 and 3 it would be apparent that other shapes and configurations of extensions may be used to prevent the inlet pipe from contacting the base surface 225. For example, more or fewer than three extensions may be used. Arrangements of extensions in a geometric arrangement, such as rows or a plurality of dimples, may be included in the liquid receptacle 200. The peg 235 used to secure the liquid receptacle 200 to the housing 105 may protrude through a cutaway 140. The housing 105 is also shown having a slot 130 extending into the liquid receiving volume defined by the inner wall 205. The slot 130 is configured to receive a liquid level sensor 165 (see also FIG. 6) that can detect a liquid level within the liquid receptacle 200 and control the pump 300 accordingly. While the liquid level sensor 165 is preferably a non-contact sensor, such as a capacitance sensor, it would be apparent that another type of liquid level sensor may be used instead.

As shown in FIG. 3, the pump 300 contained within the housing 105 is connected to the liquid receptacle 200 by a pump inlet tube 310 and to the fluid outlet chamber 400 by a pump outlet tube 325. The arrangement of inlet 310 and outlet tubes 325 are such that the pump 300 is suspended from the housing 105 and may be considered as an anti-vibration arrangement configured to reduce the noise of the condensate pump assembly 100 in use. Suspending the pump 300 from the housing 105 minimises the vibrations that are transmitted from the pump 300 to the housing 105 during operation. The inlet 310 and outlet 325 tubes should be sufficiently soft to minimise the effects of the pulsations from the pump 300 while being hard enough to suspend the pump motor 300 to prevent it from contacting the housing 105. Inlet 310 and outlet 325 tubing having a Shore hardness in the range of 50-60 ShA have been found particularly effective. The hardness of the inlet 310 and outlet 325 tubes need not be the same. For example, the inlet tube 310 may have a hardness of 60 ShA and the outlet tube 325 may have a hardness of 50 ShA.

As shown in FIG. 3, the inlet tube 310 extends from within the liquid receiving volume to the pump 300 via a connector 315. The connector 315 secures the inlet tube 310 to the upper housing portion 110 via one or more shims 345 located between the connector 315 and one or more bosses extending from the upper housing portion 110 (see also FIG. 6). The connector 315 may be secured between the one or more bosses extending from the upper housing portion 110 and the bosses 335 extending from the housing 105. The shims are preferably made from a rubberised material and minimise the vibrations transferred to the housing 105 when pumping liquid.

The outlet tube 325 connecting the pump 300 to the fluid outlet chamber 400 is secured to the fluid outlet chamber 400 by a retaining cap 330. The retaining cap 330 may receive the outlet tube 325 and be welded to the fluid outlet chamber 400 by ultrasonic welding. The outlet tube 325 is shown receiving a barbed outlet 320 from the pump 300 in order to secure the pump 300 to the outer tube 325. Securing the inlet tube 310 to the housing 105 via the connector 315 and securing outlet tube 325 to the housing 105 via the fluid outlet chamber 400 allows the pump 300 to be mounted within the housing 105 without needing to be secured directly to the housing 105. The features of the inlet 310 and outlet 325 tubing are such that the need for a compliant material, to minimise the vibrations transmitted through the tubing, is balanced with the need for a sufficiently stiff material that is able to support the forces exerted by the pump 300 in operation.

When liquid is pumped out of the pump 300, pulsations passing through the outlet tube 325 result in the expansion of the outlet tube 325. As a softer outlet tube 325 is desirable from a noise-reduction perspective, there is a risk the pulsations may result in the outlet tube 325 coming loose from the pump motor outlet 320 and leaking within the housing 105. In extreme cases, the outlet tube 325 may rupture due to the pressures within the outlet tube 325. To mitigate these risks, a wire clip may be used to secure the outlet tube 325 to the pump outlet 320. Further, to reduce the risk of damage to the outlet tube 325, one or more rings 340, such as those illustrated in FIGS. 3 and 4, may be used to constrain the radial expansion of the outlet tube 325. This provides a pump 100 having the noise-reduction advantages of a softer outlet tube 325 while having the strength of a harder outlet tube 325. Where more than one ring is used, the rings 340 may be spaced in an equidistant manner along the outlet tube 325 so that the rings 340 do not touch each other due to the sagging of the inlet 310 and outlet 325 tubes. This is desirable, as the rings 340 are vibrating due to the pulsations. Therefore, if the rings 340 are allowed to contact one another, this would generate further noise within the pump. The rings preferably have a hardness in the range of 60-70 ShA. As the rings 340 may have an outer diameter considerably greater than the outlet tube 325, the rings 340 may be made from a softer material than the outlet tube 325. The rings 340 may perform their described function if the pump 100 is mounted horizontally or vertically, or at any angle in between.

Figure 7:
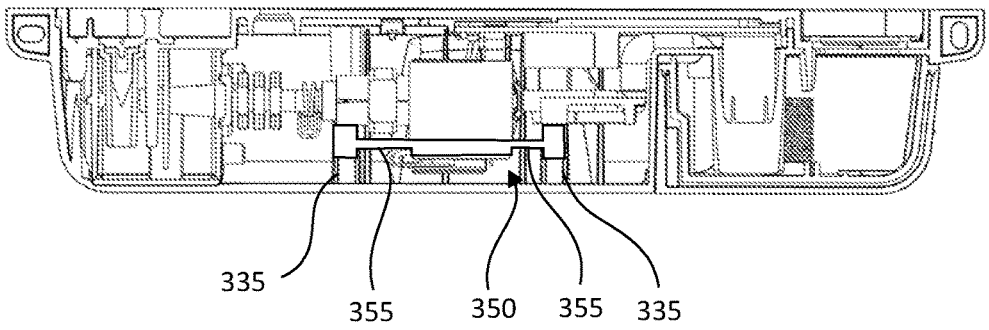
FIG. 7 is a cross-sectional view of the condensate pump assembly showing the cradle member supporting the pump motor.

A cradle 350 (see FIG. 7) may be used, either in combination with or as an alternative to, the inlet 310 and outlet tubes 325 illustrated in FIG. 3. A plurality of bosses 335 are shown in FIG. 3 that are used to secure the upper housing portion 110 to the housing 105. The cradle 350 may be secured to the bosses 335 to create a sling below the pump 300 able to suspend the pump from the bottom surface 120 of the housing 105. Preferably, the cradle 350 comprises four arms 355 having ends that are looped around the bosses 335 securing the upper housing portion 110 to the housing 105. As the pump 300 is suspended by the cradle 350, this places the arms 355 under tension and reduces the likelihood of the pump 300 contacting the housing 105 and generating noise in operation. The cradle 350 may have a higher Shore hardness than the inlet 310 and/or outlet 325 tubes to prevent excessive displacement of the pump motor 300 in a vertical direction when the pump 100 is mounted horizontally. When a cradle 350 is used, softer inlet 310 and outlet 325 tubes may be used, as the cradle 350 is able to provide additional support for the pump motor 300. In this case, tubes having a hardness in the range of 30-40 ShA may be used for the inlet 310 and/or outlet 325 tubes.

It would be appreciated that the illustrated arrangement is just one way of suspending the pump and that other arrangements suitable for suspending the pump 300 would be included by this description. The pump 100 may alternatively be mounted in a vertical arrangement, that is to say, where the pump motor 300 oscillates in a vertical direction. In this case, the higher of the inlet 310 and outlet 325 tube would be in tension and the lower of the inlet 310 and outlet 325 pipe would be in compression. In this case, the hardness of the pipes may be different to those selected for horizontal mounting of the pump 100. A cradle 350 may also be utilised in a vertically-mounted pump 100 and the specific choice of hardness to suspend the pump motor 300 may also differ to that required when the pump 100 is mounted horizontally.

Figure 4A:
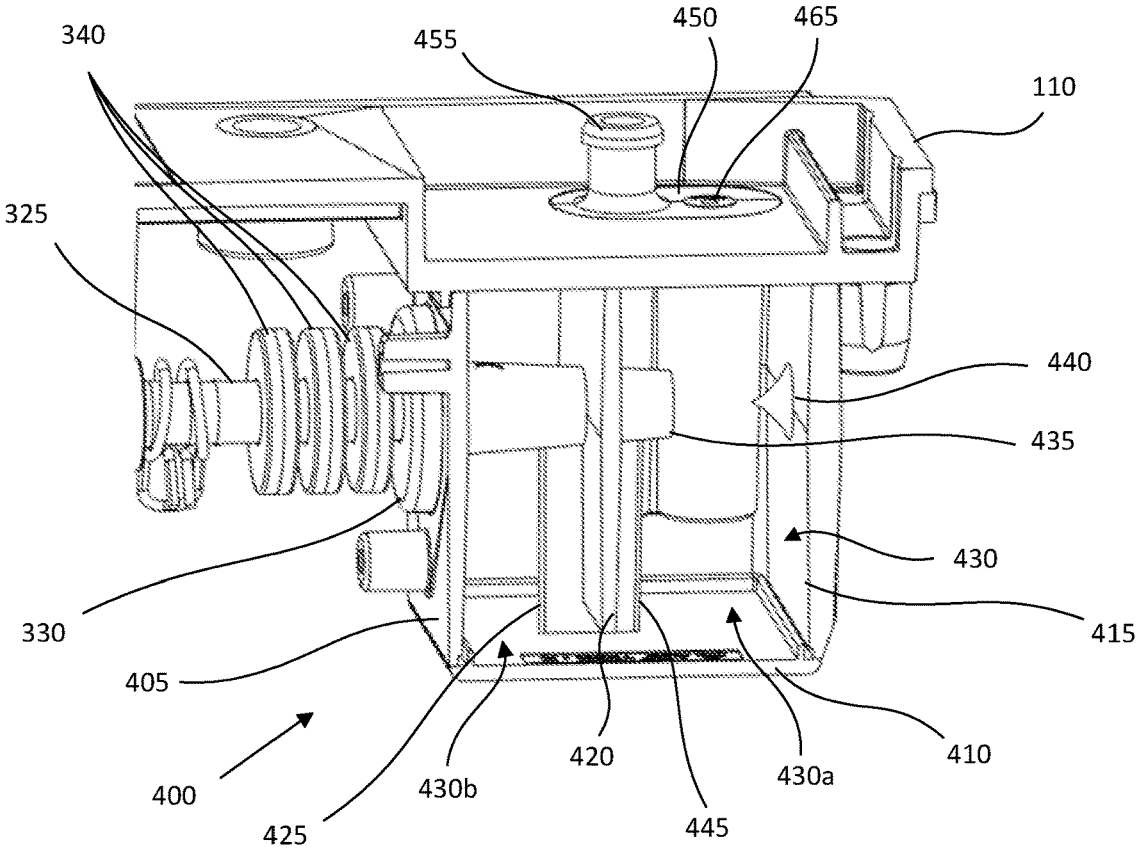
FIGS. 4A and 4B show views of the fluid outlet chamber.
Figure 4B:
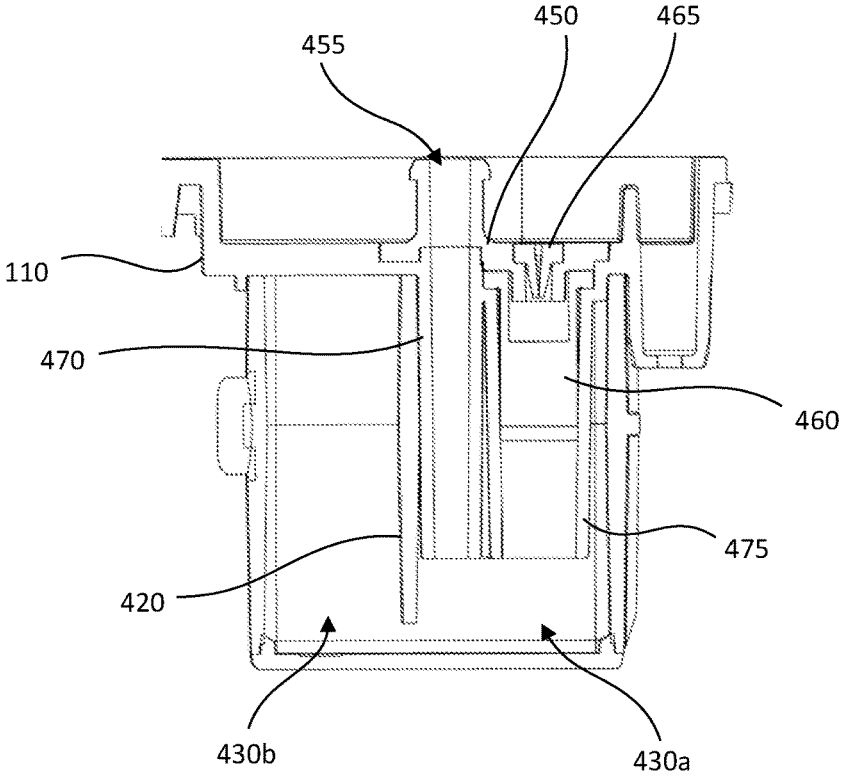

FIGS. 4A and 4B show views of the fluid outlet chamber. FIG. 4A shows a cross-sectional view of the internal components of the fluid outlet chamber 400. The internal volume 430 of the fluid outlet chamber 400 is defined by of a plurality of side walls 415, a bottom wall 410 and the upper housing portion 110. The fluid outlet chamber 400 is secured to the upper housing portion 110 and contained within the housing 105. A liquid inlet channel 435 is shown extending through a first side wall 405 of the outlet chamber 400. The liquid inlet channel 435 is in fluid communication with the pump 300 and receives liquid pumped from the pump 300. A first dividing wall 420 extending between opposed second and third side walls divides the internal volume 430 into a first 430*a* and second 430*b* regions. The first dividing wall extends from the upper housing portion towards the bottom wall 410, but terminates above the bottom wall 410 to allow the first 430*a* and second 430*b* regions to remain in fluid communication. The second region 430*b* is configured to maintain a pocket of air such that pulsations within liquid entering the liquid outlet chamber 400 are dissipated by the pocket of air prior to the liquid being discharge through a liquid outlet port 455. The liquid inlet channel 435 is shown extending into the first region 430*a*. As liquid enters the fluid outlet chamber 400, the liquid level will rise within the fluid outlet chamber 400 and trap a pocket of air within the second region 430*b*. An air pocket may also be trapped within the first region 430*a*. This effectively allows the liquid within the fluid outlet chamber 400 to become compressible and enables pulsations within the liquid to be effectively dissipated prior to being discharged. To further enhance the dissipation of pulsations within liquid entering the liquid outlet chamber 400, a protrusion 440 may be included within the fluid outlet chamber 400. As shown, the protrusion 440 is formed on a fourth side wall 415 of the fluid outlet chamber 400 at approximately the same distance from the bottom surface 410 as the liquid inlet channel 435. The liquid inlet channel 435 is configured to direct liquid towards the protrusion 440 in order to break up the pulsations within the liquid directed towards the fourth side wall 415. The liquid inlet channel may include an internal profile that tapers in the direction of fluid flow.

The fluid outlet chamber 400 may include a second dividing wall 425 to prevent the first dividing wall 420 deflecting due to the pressure of the liquid expelled from the liquid inlet channel 435. When the first dividing wall 420 is secured to the housing by ultrasonic welds, the second dividing wall 425 may be omitted from the fluid outlet chamber 400. The protrusion 440 may be configured to redirect liquid away from the fourth side wall 415 and towards the second region 430*b* and/or the second dividing wall 425 to further dissipate pulsations within the liquid. The protrusion 440 may include a conical profile. The protrusion 440 may include one or more rubberised materials. The second dividing wall 425 may extend from the base wall 410 to the liquid inlet channel 435. The second dividing wall 425 may include a bevelled edge 445. The bevelled edge 445 may extend substantially the length of the second dividing wall 425.

The fluid outlet chamber 400 may include a liquid outlet channel 470 that extends from the upper housing portion 110 into the first region 430*a* and terminates near the bottom wall 410 (see also FIG. 4B). The upper housing portion 110 may include an air inlet channel 475 that extends into the first region 430*a*. To prevent liquid egressing from the fluid outlet chamber 400 through the air inlet channel 475, the air inlet channel 475 may include a one-way valve 460 to allow fluid to enter the chamber via the air inlet channel 475, but to prevent fluid from leaving the chamber via the air inlet channel 475. The air inlet channel 475 acts as an anti-syphoning device. This arises from the pressure difference between the discharge line continuing to remove liquid from the fluid outlet chamber 400 when the pump 300 is switched off. Without an anti-syphoning device, the pump 300 would ordinarily run dry as liquid would be drawn through the pump 300. This would lead to the pump 300 starting up from a 'dry' state, which in turn would result in the pump 300 operating in a noisy manner. As air is drawn through the one-way valve, this can lead to audible levels of noise, as the valve is repeatedly opened. To mitigate against this noise, a damper may be introduced upstream of the one-way valve, to dampen the noise emitted by the one-way valve. The damper may be a second one-way valve 465. As shown in FIGS. 4A and 4B, the liquid outlet 455 may be formed as part of an outlet member 450 that is secured to the upper housing portion 110. The outlet member 450 may be ultrasonically welded to the upper housing portion 110. The outlet member 450 may also contain the second one-way valve 465. While the fluid outlet is shown as a barbed male member, but it would be apparent that this was not essential to the present disclosure.

Figure 5A:
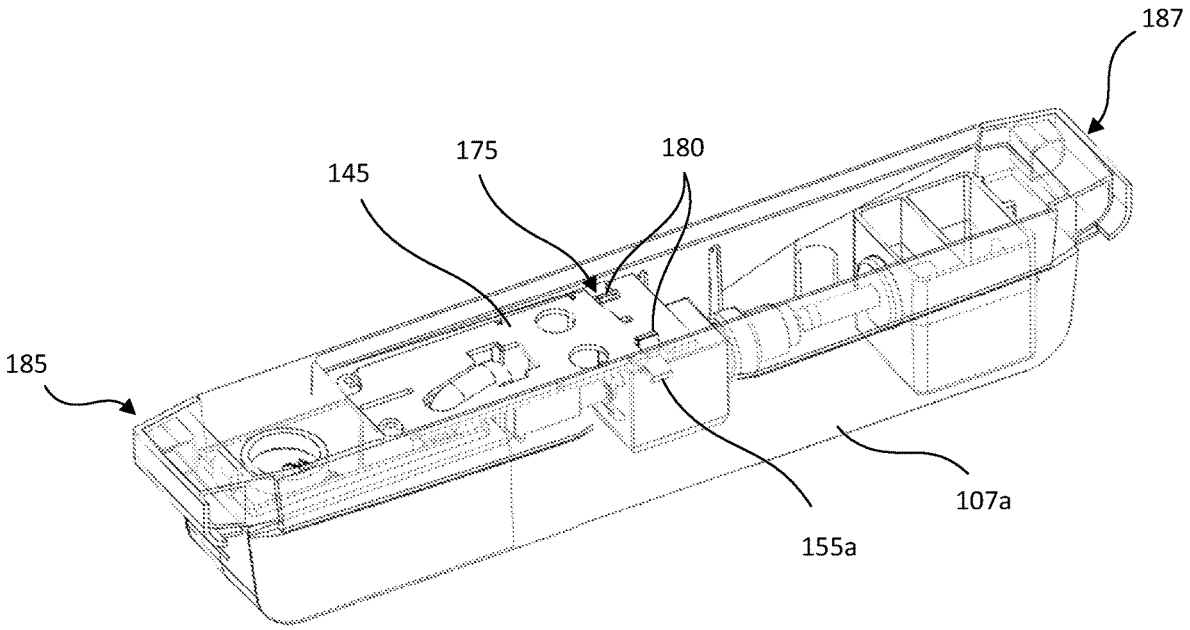
FIGS. 5A and 5B show illustrations of the condensate pump assembly with the upper housing portion removed and showing light tubes directing a signal through the side wall of the housing.
Figure 5B:
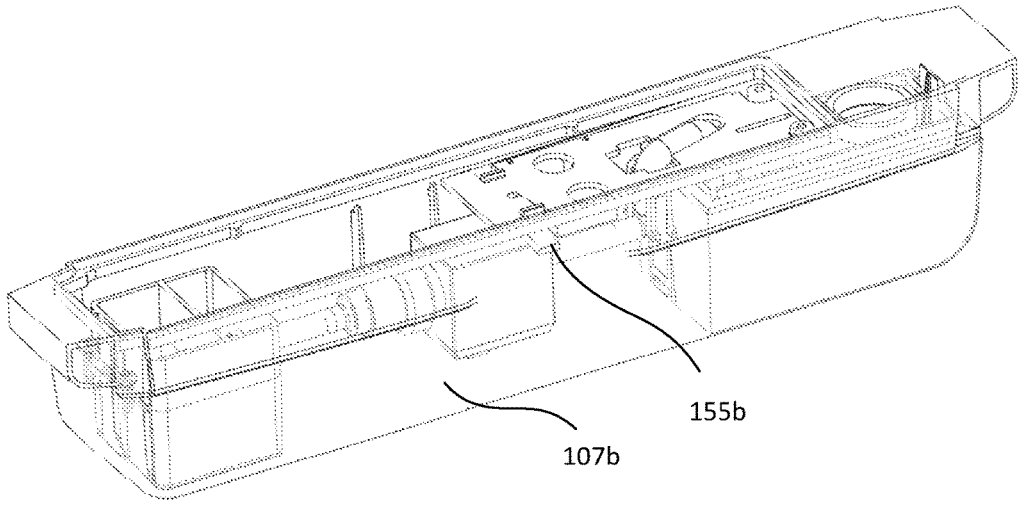
Figure 6:
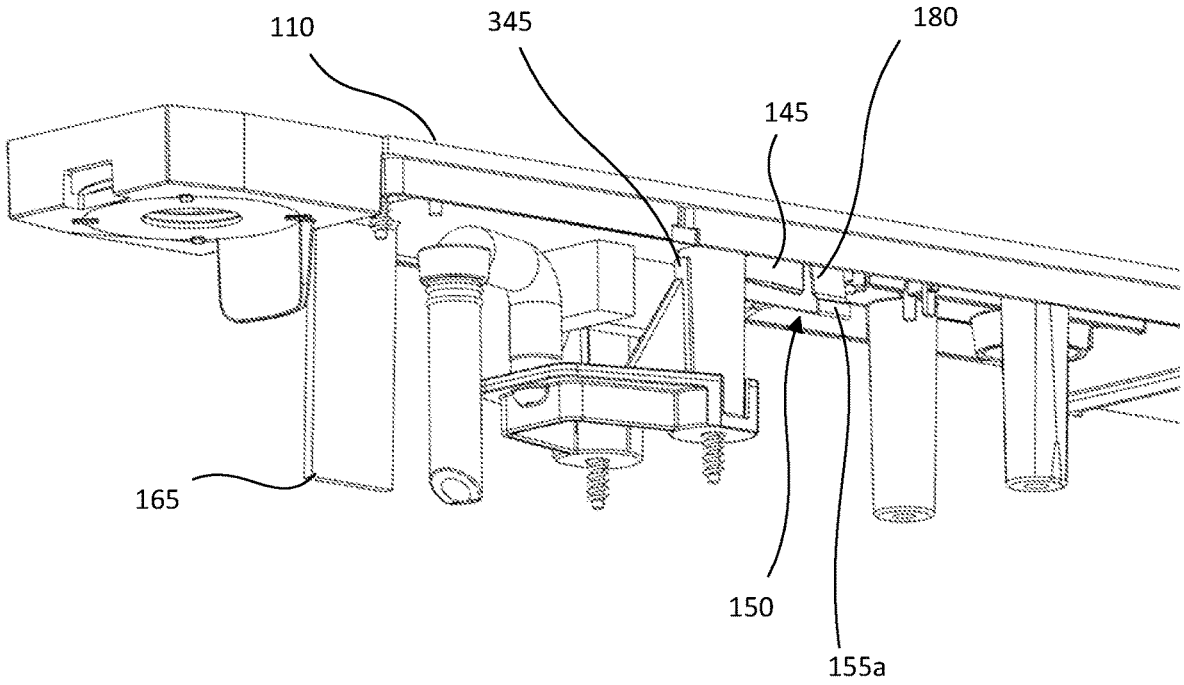
FIG. 6 shows an illustration of the light tube arrangement mounted to a PCB.

FIGS. 5A and 5B show illustrations of the condensate pump assembly with the upper housing portion removed and showing light tubes directing a signal through the side wall of the housing. FIG. 5A shows a first view of the condensate pump assembly and FIG. 5B shows the condensate pump assembly from the reverse side of that shown in FIG. 5A. The housing 105 has been shown as transparent to illustrate the components located below the upper housing portion 110. FIGS. 1 and 6 are relevant to the description of FIGS. 5A and 5B.

The condensate pump assembly includes a liquid level sensor 165 configured to detect a liquid level within the liquid receptacle 200. As shown, the liquid level sensor 165 is a dip-sensor configured to output a signal indicative of the liquid level within the liquid receptacle 200 by detecting when liquid is covering at least a portion of the liquid level sensor 165. In this example, the liquid level sensor 165 is a capacitive liquid level sensor arranged to output a signal indicative of the liquid level within the liquid receptacle 200 based on a change in capacitance of the medium in contact with a portion of the liquid level sensor 165. It will be appreciated, however, that another type of liquid level sensor may be used instead.

The condensate pump assembly 100 further comprises a pump controller. The pump controller may be implemented in hardware or software, or a combination of both. The pump controller is configured to operate the pump 300 when the liquid level sensor 165 outputs a first signal indicative of a liquid level within the liquid receptacle 200 at least a predetermined amount above a lower end of the slot 130 the liquid level sensor 165 is located within. The pump controller is also configured to stop the pump 300 when the liquid level sensor 165 outputs a second signal indicative of a liquid level within the liquid receptacle 200 approaching or below a level of the liquid inlet 115. The pump controller is also configured to output a warning when the liquid level sensor 165 outputs a warning signal indicative of a liquid level within the liquid receptacle 200 above a predetermined warning level within the liquid receptacle 200. The air conditioning system is configured to stop operation of the air conditioning unit in response to the warning output.

The condensate pump assembly 100 may include a PCB 145 with the pump controller mounted thereon. The controller may include at least one light source configured to emit a signal indicative of the operating status of the condensate pump assembly 100. The light source may be in the form of at least one LED. The pump assembly may also include a light tube arrangement 150 having display ends 155*a*, 155*b* and arranged to transmit light emitted from the light source to the display ends 155*a*, 155*b*. The light tube arrangement 150 may be secured to the PCB 145 by one or more mechanical fasteners 180. The light tube may comprise a first light path to one of the side walls and a second light path to the other of the side walls. This would enable the signal to be visible through either of the opposed side walls, when the condensate pump arrangement is mounted in both the left- or right-handed configuration. The PCB 145 may be secured to the upper housing portion 110 by heat-staking or by mechanical fasteners such as cantilevers or screws.

To indicate the operating status of the condensate pump assembly 100, the pump controller may direct the light emitted from the light source to both of the opposed first 107*a* and second 107*b* side walls of the housing 105. This enables the light from the light source, which may not have otherwise been observable, to be presented to a user through one of the side walls 107*a*, 107*b*. To enhance the visibility of the signal, each of the side walls 107*a*, 107*b* may include a thinned section 125. This will enable a greater proportion of the light emitted from the ends 155*a*, 155*b* of the light tube arrangement 150 to be transmitted through the side walls 107*a*, 107*b* and observed by a user. The ability to pipe light to different faces of the housing 105 provides a condensate pump assembly that can be mounted in multiple configurations compared to prior art pump assemblies.

A first side wall 107*a* of the condensate pump assembly 100 is provided with a first mounting portion in the form of a first mounting point 185 and a second mounting portion in the form of a second mounting point 187. The first mounting point 185 and the second mounting point 187 are usable to affix the condensate pump assembly 100 to a wall of a room or building, below the air conditioning unit of the air conditioning system. Alternatively, the first mounting point 185 and the second mounting point 187 can be provided on a second longitudinal side wall of the condensate pump assembly 100, opposite the first longitudinal side wall, whereby to mount the condensate pump assembly 100 after rotation by 180 degrees about an axis aligned with a direction of gravity. In this way, the condensate pump assembly 100 can be mounted such that the liquid receptacle 200 is provided at either a left or a right side of the condensate pump assembly 100, when the condensate pump assembly 100 is mounted to a wall of the room or building containing the air conditioning unit. This is particularly useful in space-constrained environments where accessibility to the condensate pump assembly 100 may be difficult. For example, when an air-conditioning unit has an outlet hose at one end of the unit, this would typically dictate where the condensate pump can be mounted, which can result in an aesthetically unappealing installation. However, installers may mount the present pump assembly as they wish, due to the reversibility of the light tube arrangement 150 and the mounting portions 185, 187. This results a condensate pump assembly 100 that is able to display its operating status information in a discrete manner when the pump is mounted in different orientations, without compromising on the aesthetics of the installed unit.

The fluid outlet chamber 400 may be manufactured by welding the different components of the condensate pump assembly together. The bottom wall 410 is first welded to the side walls of the fluid outlet chamber 400 to form an open fluid outlet chamber. The connecting tube 325 from the pump outlet 320 may then be passed through the retaining cap 330 before the connecting tube 325 is sealed onto the first side wall 405 by welding the retaining cap 330 to the first side wall 405. The upper housing portion 110 may then be welded to the open fluid outlet chamber. Upon welding the upper housing portion 110 to the open fluid outlet chamber, the sealed fluid outlet chamber 400 is formed. The upper housing portion 110 may then be secured to the housing 105. Where the outlet member 450 is present, this may be welded to the upper housing portion 110 prior to welding the bottom wall 410 being welded to the side walls. Where a damper 465 is present, the damper 465 may be inserted into the air inlet channel 475 prior to welding the outlet member 450 to the upper housing portion 110. The welds may be achieved by ultrasonic welding.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Also disclosed are the following numbered clauses.

1. A condensate pump assembly for use in an air conditioning system, the condensate pump assembly comprising:
   a pump arranged in a housing to pump liquid from a liquid inlet to a liquid outlet;
   a liquid receptacle configured to receive liquid from the liquid inlet; and
   at least one light source configured to emit a signal indicative of the status of the condensate pump assembly and a light tube configured to transmit the signal,
   wherein the housing further comprises an upper portion and opposed side walls, and
   wherein the side walls are configured such that, in use, the signal is visible from outside the housing.
2. A condensate pump assembly according to clause 1, wherein the light tube comprises a first light path to one of the side walls and a second light path to the other of the side walls, whereby the signal is visible through either of the opposed side walls.
3. A condensate pump assembly according to clause 1 or clause 2, wherein each of the opposed side walls comprises a thinned section, and wherein the light tube is configured to direct the signal towards the thinned sections.

4. A condensate pump assembly according to any of clauses 1 to 3, wherein the liquid receptacle comprises an inner wall defining a liquid receiving volume and an outer wall defining an outer extent, and wherein an insulating gap is formed between the inner and outer walls 5. A condensate pump assembly for use in an air conditioning system, the condensate pump assembly comprising:
   a pump arranged in a housing to pump liquid from a liquid inlet to a liquid outlet; and
   a liquid receptacle configured to receive liquid from the liquid inlet;
   wherein the liquid receptacle comprises an inner wall defining a liquid receiving volume and an outer wall defining an outer extent, and
   wherein an insulating gap is formed between the inner and outer walls.

6. A condensate pump assembly according to clause 4 or clause 5, wherein the inner wall is welded to the outer wall.

7. A condensate pump assembly according to any of clauses 4 to 6, wherein the liquid receptacle is releasably secured to the housing.

8. A condensate pump assembly according to clause 7, wherein the liquid receptacle is releasably secured to the housing by selective release means.

9. A condensate pump assembly according to clause 8, wherein the selective release means comprises at least one snap-fit joint at a first end of the liquid receptacle.

10. A condensate pump assembly according to clause 8 or clause 9, wherein the selective release means comprises a peg member at a second end opposed to the first end of the liquid receptacle, and wherein the peg member is configured, in use, to apply a force against the housing to secure the liquid receptacle when attached to the housing.

11. A condensate pump assembly according to clause 10, wherein the liquid receptacle comprises a support member configured to resist bending of the peg member.

12. A condensate pump assembly according to any of clauses 7 to 11, wherein the liquid receptacle is configured to be releasable by a hand of a user.

13. A condensate pump assembly according to any of clauses 7 to 12, wherein the selective release means is operable by squeezing a thumb of the hand towards a finger of the hand or vice versa.

The invention claimed is:

1. A condensate pump assembly for use in an air conditioning system, the condensate pump assembly comprising:
   a pump arranged in a housing to pump liquid from a liquid inlet to a liquid outlet;
   a liquid receptacle configured to receive liquid from the liquid inlet; and
   first and second tube elements configured to suspend the pump from a bottom surface of the housing to substantially eliminate vibrations being transmitted from the pump to the housing, wherein the first tube element is configured to connect the liquid receptacle to a pump inlet, and the second tube element is configured to connect a pump outlet to the liquid outlet, and wherein the first tube element has a first hardness and the second tube element has a second hardness that is different than the first hardness.

2. The condensate pump assembly according to claim 1, wherein the first and second tube elements have a hardness in the range of 50-60 ShA.

3. The condensate pump assembly according to claim 1, further comprising a cradle member secured to the housing and configured to suspend the pump.

4. The condensate pump assembly according to claim 3, wherein the cradle member comprises a plurality of arms extending to the housing and configured to attach to the housing and support the pump.

5. The condensate pump assembly according to claim 1, wherein the first hardness and second hardness are in the range of 30-40 ShA.

6. The condensate pump assembly according to claim 1, further comprising one or more rings arranged around the second tube element, wherein the second tube element extends through the one or more rings, and wherein the one or more rings restrict expansion of the second tube element member in a radial direction of each of the one or more rings.

7. The condensate pump according to claim 6, wherein the one or more rings are equally spaced between the pump and the liquid outlet.

8. The condensate pump according to claim 6, wherein the one or more rings have a hardness in the range of 60-70 ShA.

9. The condensate pump assembly according to claim 6, further comprising a cradle member configured to suspend the pump.

10. The condensate pump assembly according to claim 6, further comprising a fluid outlet chamber having a bottom wall and a plurality of side walls, wherein the fluid outlet chamber is secured to an upper portion of the housing, wherein a first side wall comprises a liquid inlet channel in fluid communication with the pump, a dividing wall extends between opposed second and third side walls to define first and second fluid regions within the fluid outlet chamber, wherein the second fluid region is configured to maintain a pocket of air, and wherein pulsations within liquid entering the fluid outlet chamber are dissipated by the pocket of air prior to liquid being discharged through the liquid outlet.

11. The condensate pump assembly according to claim 10, wherein the liquid inlet channel is configured to direct liquid towards a protrusion extending from a fourth side wall, wherein the fourth side wall is opposed to the first side wall, and wherein the protrusion is configured to dissipate energy within the liquid entering the fluid outlet chamber.

12. The condensate pump assembly according to claim 10, further comprising an air inlet channel having a one-way valve configured to allow air to flow into the fluid outlet chamber.

13. The condensate pump assembly according to claim 10, further comprising a liquid level sensor configured to detect a liquid level within the liquid receptacle, and a controller configured to operate the pump when the liquid level sensor outputs a first signal indicative of the liquid level being above a level of a tube inlet of the first tube element disposed in the liquid receptable, and to stop the pump when the liquid level sensor outputs a second signal indicative of the liquid level approaching or being below the level of the tube inlet.

14. The condensate pump assembly according to claim 10, further comprising an annular member secured to the liquid inlet and configured to receive a liquid inlet line.

15. The condensate pump assembly according to claim 14, wherein the annular member is twin-shot moulded to the liquid inlet.

16. A condensate pump assembly for use in an air conditioning system, the condensate pump assembly comprising:

a pump arranged in a housing to pump liquid from a liquid inlet to a liquid outlet;

a liquid receptacle configured to receive liquid from the liquid inlet; and a fluid outlet chamber having a bottom wall and a plurality of side walls, wherein the fluid outlet chamber is secured to an upper portion of the housing, wherein a first side wall comprises a liquid inlet channel in fluid communication with the pump, wherein the fluid outlet chamber comprises a dividing wall extending between opposed second and third side walls to define first and second fluid regions within the fluid outlet chamber, wherein the second region is configured to maintain a pocket of air, wherein pulsations within liquid entering the fluid outlet chamber are dissipated by the pocket of air prior to liquid being discharged through the liquid outlet, and wherein the liquid inlet channel is configured to direct liquid towards a protrusion extending from a fourth side wall, wherein the fourth side wall is opposed to the first side wall, and wherein the protrusion is configured to dissipate energy within the liquid entering the fluid outlet chamber.

17. The condensate pump assembly according to claim 16, further comprising an annular member secured to the liquid inlet and configured to receive a liquid inlet line.

18. The condensate pump assembly according to claim 17, wherein the annular member is twin-shot moulded to the liquid inlet.

19. A condensate pump assembly for use in an air conditioning system, the condensate pump assembly comprising:

a pump arranged in a housing to pump liquid from a liquid inlet to a liquid outlet, a liquid receptacle configured to receive liquid from the liquid inlet;

first and second tube elements configured to suspend the pump from a bottom surface of the housing to reduce vibrations being transmitted from the pump to the housing, wherein the first tube element has a tube inlet disposed in the liquid receptacle and is configured to connect the liquid receptacle to a pump inlet, and the second tube element is configured to connect a pump outlet to the liquid outlet, and wherein the first tube element has a first hardness and the second tube element has a second hardness that is different than the first hardness;

one or more rings arranged around the second tube element, wherein the second tube element extends through the one or more rings, and wherein the one or more rings restrict expansion of the second tube element member in a radial direction of each of the one or more rings;

a liquid level sensor configured to detect a liquid level within the liquid receptacle; and a controller configured to operate the pump when the liquid level sensor outputs a first signal indicative of the liquid level being above a level of the tube inlet, and to stop the pump when the liquid level sensor outputs a second signal indicative of the liquid level approaching or being below the level of the tube inlet.

* * * * *